US006329318B1

(12) United States Patent
McFall

(10) Patent No.: US 6,329,318 B1
(45) Date of Patent: Dec. 11, 2001

(54) LAMINATION AND METHOD FOR FORMING AN INFORMATION DISPLAYING LABEL

(75) Inventor: Brian L. McFall, St. Joseph, MI (US)

(73) Assignee: Thelamco, Incorporated, Benton Harbor, MI (US)

( * ) Notice: Subject to any disclaimer, the term of this patent is extended or adjusted under 35 U.S.C. 154(b) by 0 days.

(21) Appl. No.: 09/431,070

(22) Filed: Nov. 10, 1999

(51) Int. Cl.[7] ..... B41M 5/40

(52) U.S. Cl. ..... 503/201; 427/150; 427/152; 503/200; 503/226

(58) Field of Search ..... 427/150, 152; 503/200, 201, 226

(56) References Cited

U.S. PATENT DOCUMENTS

| | | |
|---|---|---|
| 3,388,019 | 6/1968 | Thigpen . |
| 4,335,188 | 6/1982 | Igi et al. . |
| 4,392,905 | 7/1983 | Boyd et al. . |
| 4,505,975 | 3/1985 | Majima . |
| 4,567,114 | 1/1986 | Oshima et al. . |
| 4,599,259 | 7/1986 | Kobayashi et al. . |
| 4,610,744 | 9/1986 | Smith et al. . |
| 4,707,406 | 11/1987 | Inaba et al. . |
| 4,722,868 | 2/1988 | Pope . |
| 4,746,646 | 5/1988 | Nakanishi et al. . |
| 4,946,372 | 8/1990 | Avni . |
| 5,242,739 | 9/1993 | Kronzer et al. . |
| 5,262,224 | 11/1993 | Ozaki et al. . |
| 5,271,990 | 12/1993 | Kronzer et al. . |
| 5,294,483 | 3/1994 | Beavers et al. . |
| 5,501,902 | 3/1996 | Kronzer . |
| 5,543,191 | 8/1996 | Dronzek, Jr. et al. . |
| 5,576,092 | 11/1996 | Jongewaard et al. . |
| 5,798,179 | 8/1998 | Kronzer . |

*Primary Examiner*—Bruce H. Hess
(74) *Attorney, Agent, or Firm*—Cook,Alex,McFarron,Manzo,Cummings & Mehler, Ltd.

(57) ABSTRACT

A lamination and method provide for an information displaying label with dual image receiving capabilities. The laminate includes a substrate with a thermally responsive coating in adhesive engagement with an overlying light transmissive protective layer. The thermally responsive coating is adapted to receive an information image upon the selective application of heat at a first temperature. The adhesive layer, which is non-reactive with the coating, bonds the coating and the protective layer together when heated to a second temperature lower than the first temperature. The adhesive layer provides a permanent and stable bond and may include ultraviolet inhibitors. The protective layer permits the transfer of heat to the underlying coating and provides an image receiving surface for additional label printing. The protective layer also protects the coating from environmental elements such as heat, moisture, chemicals and abrasions.

10 Claims, 1 Drawing Sheet

LAMINATION AND METHOD FOR FORMING AN INFORMATION DISPLAYING LABEL

FIELD OF THE INVENTION

The present invention relates to a lamination with a dual image receiving capability and a method of making such a lamination. Specifically, in the labeling industry, there is a need for a laminate in which there is a protected thermally responsive information receiving surface with a protective layer providing a second information receiving surface.

The invention provides a laminate for forming an information displaying label which is capable of displaying an image on a protective layer and on the underlying thermally responsive coating. The protective layer provides for image printing on its own surface and provides for the formation of heat activated images on an underlying coating. The protective layer is transmissive to light so that both images may be viewed simultaneously. The invention further provides a laminate that protects the coating from excessive heat, moisture, chemicals, abrasions and ultraviolet light.

SUMMARY OF THE INVENTION

The present invention relates to laminates, particularly a substrate with a thermally responsive coating in adhesive engagement with an overlying protective layer. The invention provides a lamination with a dual image receiving capability, one on the coating and the other on the protective layer.

A primary purpose of the invention is to provide a lamination which allows image formation on the coating by the selective application of heat and allows label printing on the protective layer.

Another purpose of the invention is to provide a protective layer which has heat transmissive and light transmissive properties and is environmentally resistant to heat, moisture, chemicals and abrasions.

Another purpose of the invention is to provide a protective layer with surface characteristics specially adapted to accept ink printing.

Another purpose is to provide a lamination as described which uses an adhesive with an ultraviolet light inhibitor.

Another purpose of the invention is to provide a method for forming an information displaying label as described.

Other purposes will appear in the ensuing specification, drawings and claims.

DETAILED DESCRIPTION OF THE PREFERRED EMBODIMENT

Figure 1:
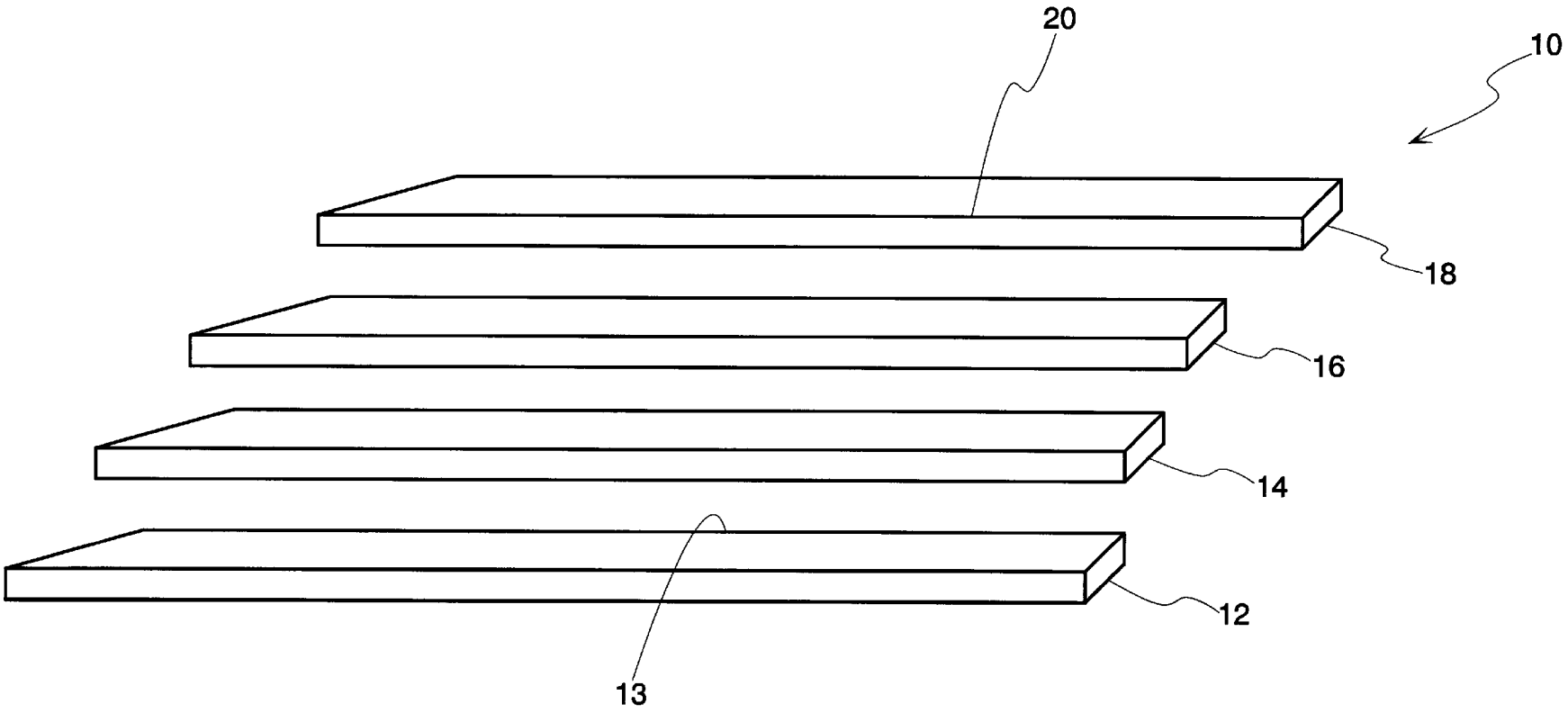
In FIG. 1, the invention is illustrated diagrammatically in the exploded perspective view of a laminate as described.

The present invention relates to a lamination for forming information display images and to a method for making such a laminate.

The lamination 10 includes a substrate 12 with a thermally responsive coating 14 protected by the over-lamination of an adhesive layer 16 and a light transmissive protective layer 18.

The substrate 12 may be made from paper, film, board or a nonwoven material. The substrate 12 is covered on at least one side 13 with a thermally responsive coating 14. The coating 14 is a paper or film that responds to heat at a predetermined temperature to form an information image thereon. The temperature is determined by the type of coating 14. Heat is selectively applied at the appropriate temperature to certain areas of the coating where an image is desired. Examples of coatings include but are not limited to "T1057" and "T2062" which are manufactured by the Appleton Paper Company. Other coatings will be apparent to those skilled in the art. Coating choices will also be influenced by the characteristics of the chosen substrate.

The adhesive layer 16 bonds the coating 14 to the light transmissive protective layer 18. The adhesive layer 16 provides a permanent and stable bond between the coating 14 and the protective layer 18. The adhesive layer 16 is non-reactive with the coating 14 and activates at a temperature lower than the temperature applied to form an information image on the coating 14. The preferred adhesive is a "dry" bonding type which has clear and non-yellowing properties. Possible adhesive choices may be, but are not limited to, "Adcote 331" from Morton International and "AV5100" from Pierce & Stevens Company. Specific uses of the laminates may require that ultraviolet inhibitors be added to the adhesive to protect the coating from sunlight exposure. One type of ultraviolet inhibiting adhesive includes a blend of "EPS72-EA70" and catalyst CA720 at a 100:14 ratio, also available from Pierce & Stevens Company. Other examples of adhesives with and without ultraviolet inhibitors will be apparent to one skilled in the art.

The light transmissive protective layer 18 overlays the coating 14 and is bonded thereto by the adhesive layer 16. The protective layer 18 permits heat transmission to the underlying coating 14 and includes an image receiving surface 20 which accepts label printing. The protective layer 18 is heat transmissive to permit thermal activation of the underlying coating 14 so that an information image may be formed on the coating upon selective application of heat to the lamination 10. The image receiving surface 20 is specially adapted to facilitate label printing on the protective layer 18. The characteristics of the image receiving surface 20 include a high surface energy and appropriate surface tension.

The light transmissive properties of the protective layer 18 allow both the underlying coating image and the overlying label printing to be viewed simultaneously. It is also important for the protective layer 18 to prevent destruction of the coating from environmental elements. Thus, the protective layer 18 has high resistance to heat, moisture, common chemicals and abrasions. A protective layer 18 of polyester film is preferred, particularly with a 48 gauge thickness, but other thicknesses may be used. Other protective layer materials with heat and light transmissibility will be known to one skilled in the art.

The method for forming a label laminate includes the steps of coating a substrate 12 with a thermally responsive coating 14, applying an adhesive layer 16, applying a light transmissive protective layer 18, and heating the adhesive layer 16.

First, the substrate 12 is coated with a thermally responsive coating 14 which is capable of forming an image upon heat application at a first temperature. The coating 14 is over-laminated by a dry adhesive layer 16 and a light transmissive protective layer 18. The adhesive layer 16 is non-reactive with the coating 14. Heat is applied at a second temperature lower than the first temperature which activates the adhesive layer 16 forming a permanent and stable bond between the coating 14 and the protective layer 18.

Further steps in the process may include selectively applying heat to form an image on the coating 14 and printing on the protective layer 18. The overlying protective layer 18 is transmissive to heat and light. So as heat is selectively applied at the first temperature to areas of the coating 14, an information image is formed thereon. Finally, the protective layer 18 has an image receiving surface 20 which is specially adapted to receive ink printing.

Whereas the preferred form of the invention has been shown and described herein, it should be realized that there may be many modifications, substitutions and alterations thereto.

What is claimed is:

1. A lamination for use in an information displaying label, including:

(a) a substrate;

(b) a thermally responsive coating on at least one surface of said substrate, said coating being thermally responsive to form an image when heat is selectively applied at a first temperature to said lamination;

(c) a light transmissive protective layer overlying said thermally responsive coating, said protective layer having an image receiving surface thereon and being capable of transmitting heat applied thereto at said first temperature to said thermally responsive coating to form a heat activated image thereon; and (d) an adhesive layer for bonding said protective layer to said coating, said adhesive layer providing a stable bond and being non-reactive with said coating, said adhesive layer being activated at a second temperature which is lower than said first temperature.

2. The lamination of claim 1 wherein the protective layer is made of a polyester film.

3. The lamination of claim 2 wherein the protective layer has a thickness of 48 gauge.

4. The lamination of claim 1 wherein the substrate may be formed of paper, film, board or nonwoven materials.

5. The lamination of claim 1 wherein the adhesive includes an ultraviolet inhibitor to protect the coating from sunlight exposure.

6. The lamination of claim 1 wherein the adhesive is of a dry bonding type.

7. The lamination of claim 6 wherein said adhesive is applied at a dry coat weight from 1.3 lbs. to 2.5 lbs per 3000 sq. ft.

8. A process for forming a label laminate including the steps of:

(a) coating a substrate with a thermally responsive coating, which coating is thermally responsive to the selective application of heat at a first temperature to form information images thereon;

(b) applying a dry adhesive in a predetermined amount on said thermally responsive coating, said adhesive being non-reactive with said coating;

(c) applying a light transmissive protective layer on said adhesive, said layer being heat transmissive and having an image receiving surface thereon;

(d) applying heat to said laminate at a second temperature lower than said first temperature to form a bond between said layer and coating.

9. The process of claim 8 which includes the step of selectively applying heat to said thermally responsive coating to form an information image thereon.

10. The process of claim 9 which includes the step of printing an information label on said image receiving surface of the protective layer.

* * * * *